United States Patent [19]

Hirasawa et al.

[11] 4,043,429

[45] Aug. 23, 1977

[54] ELEVATOR CAR GROUP CONTROL SYSTEM

[75] Inventors: Kotaro Hirasawa; Soshiro Kuzunuki, both of Hitachi; Tatsuo Iwasaka; Takashi Kaneko, both of Katsuta, all of Japan

[73] Assignee: Hitachi, Ltd., Japan

[21] Appl. No.: 645,345

[22] Filed: Dec. 30, 1975

[30] Foreign Application Priority Data

Jan. 6, 1975 Japan ..... 50-43

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,443,668 | 5/1969 | Hall et al. | 187/29 |
| 3,450,231 | 6/1969 | Kuzara | 187/29 |
| 3,511,342 | 5/1970 | Hall et al. | 187/29 |
| 3,739,880 | 6/1973 | Robaszkiewicz | 187/29 |
| 3,851,733 | 12/1974 | Sackin et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

An elevator car group control system for controlling a plurality of elevator cars arranged for parallel operation for serving a plurality of service floor landings of a building, comprising means for selecting suitable ones of the cars for serving hall calls, and means for forecasting the length of time required for each of the selected cars to arrive at each of the allotted hall call originating floors and displaying the forecast waiting time on display means disposed at the landing of each of the floors. In the invention, the serving car selecting means comprises means for detecting for each car the number of floors subject to change in forecast waiting time displayed at each of the already allotted floors when a new hall is originated from one of the floors, and means for preferentially selecting the car detected to provide a smaller number of floors subject to such change than the others. That is, in response to the origination of a new hall call, the number of floors subject to change in already displayed forecast waiting time due to the allotment of the new hall call is detected for each of the cars, and the car providing a smaller number of floors subject to such change than the others is preferentially selected to respond to the new hall call.

7 Claims, 15 Drawing Figures

ELEVATOR CAR GROUP CONTROL SYSTEM

This invention relates to an improved elevator control system for controlling a group of elevator cars arranged for parallel operation, and more particularly to the art of selection of a suitable one of elevator cars for responding to a new hall call originated from one of the floors of a building when such new hall call appears in addition to hall calls allotted already.

In a modern elevator control system proposed hitherto for controlling a group of elevator cars arranged for parallel operation for serving a plurality of service floor landings of a building, one of the cars is decided to serve a hall call as soon as such hall call is originated, and the information indicative of the decision of the serving car is displayed immediately at the landing of the floor from which the hall call is originated. This method is very effective in that a passenger waiting in the hall of this specific floor by depressing the hall call button is immediately informed of the car which is selected from among many cars to serve the hall call.

In order to effect such manner of allotment of a hall call to one of the cars, it is necessary to properly select the car which should serve the hall call. In a simple sense, this may be easily achieved by selecting the car which is expected to arrive at the hall call originating floor earliest of all the cars. However, the practical situation is not so simple.

According to another prior art proposal, a passenger waiting at the landing of one of the floors is informed of the length of time for which he must wait until arrival of a selected car, and this information is displayed by visual display means. However, when a new hall call is originated from another floor lying intermediate between the physical position of this selected car and the specific hall call originating floor, and this new hall call is allotted to this car, the waiting time displayed already at the specific floor does not represent the correct value any more. Suppose, for example, that a forecast waiting time of 10 seconds is displayed at the specific floor indicating that the car will arrive at this floor in 10 seconds. However, allotment of the new hall call to this car results in an increase of the waiting time from the previous value of 10 seconds to, for example, 15 seconds in spite of the fact that the waiting time of 10 seconds is actually displayed. This is undesirable in that the passenger waiting in the hall of the floor becomes distrustful of the elevator.

It is therefore an object of the present invention to provide an improved elevator car group control system in which means are provided for minimizing an undesirable change in the forecast waiting time displayed at each floor landing and displaying the waiting time as precise as possible so as to offer improved service to the passengers.

Another object of the present invention is to provide an improved elevator car group control system in which means are provided to prevent excessive extension the waiting time and to provide a substantially uniform and shortest possible waiting time for the passengers waiting at the individual floors by originating hall calls.

According to one of the important features of the present invention, the number of floors subject to change in displayed waiting time is detected for each of a plurality of cars when a new hall call is originated from one of the floors, and the car which provides a smaller number of floors subject to such change than the others is preferentially selected to respond to the new hall call.

Another important feature of the present invention resides in the fact that, when two or more of the cars are detected to provide the smaller number of floors subject to such change than the others, the car which provides a shorter forecast waiting time than the others is preferentially selected, and the new hall call is allotted to this car.

Other objects, features and advantages of the present invention will become apparent from the following detailed description taken in conjunction with the accompanying drawing, in which.

An example of relative movement of a group of elevator cars will be described with reference to FIG. 1 so that the basic principle of the present invention can be easily understood.

Figure 1:
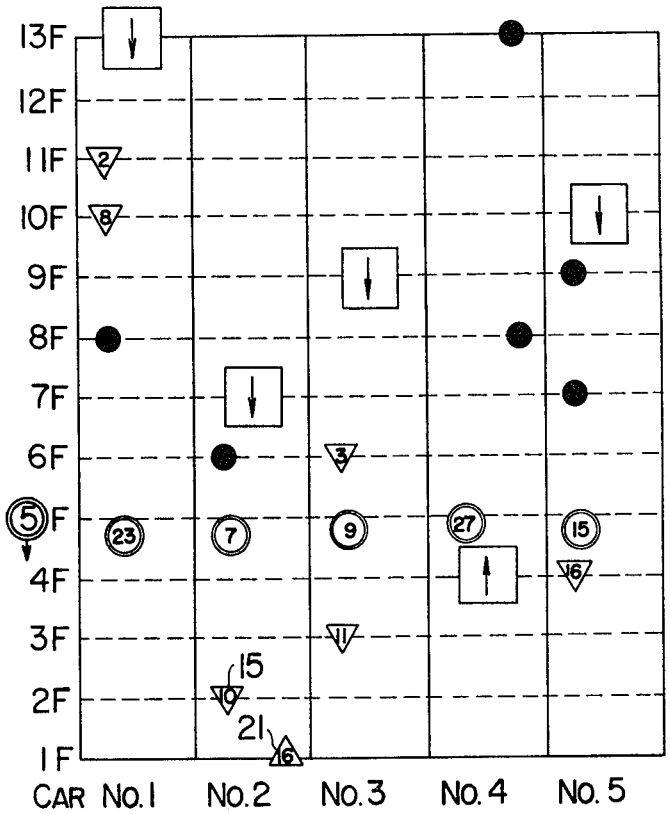
FIG. 1 is a diagrammatic view for illustrating the basic principle of the present invention.

Referring to FIG. 1, five elevator cars numbered 1 to 5 are arranged for parallel operation for serving the first to 13th floors of a building having thirteen floors. In FIG. 1, the car No. 1 is shown located at the 13th floor for downward movement, and the car No. 2 is shown located at the seventh floor for downward movement. The car No. 3 is shown located at the ninth floor for downward movement, and the car No. 4 is shown located at the fourth floor for upward movement, while the car No. 5 is shown located at the 10th floor for downward movement. The black circles in FIG. 1 represent the target floors of the individual cars registered by cage calls, and the individual cars must absolutely stop at the respective designated floors. The white triangles represent hall calls originated from the corresponding floors and allotted already to the individual cars. It will be seen that down hall calls originated from the 10th and 11th floors are allotted to the car No. 1, an up hall call and a down hall call originated from the first and second floors respectively are allotted to the car No. 2, down hall calls originated from the sixth and third floors are allotted to the car No. 3, neither up hall calls nor down hall calls are allotted to the car No. 4, and a down hall call originated from the fourth floor is allotted to the car No. 5.

Suppose, for simplicity of explanation, that the length of time required for each car to stop at one of the floors is 5 seconds, and the length of time required for each car to run one floor interval is 1 second. Then, the lengths of time required for the individual cars to arrive at the instructed floors in response to the hall calls, that is, the lengths of time for which the passengers originating the hall calls must wait at the individual floors are estimated to be the values shown in seconds in the respective triangles. In the case of the car No. 2, for example, the number of floor internals which must be run to arrive at the second floor in response to the down hall call is $7 - 2 = 5$, and the number of stops required for the car No. 2 during downward movement is one since it is instructed already by the cage call to stop at the sixth floor. Therefore, the forecast waiting time at the second floor originating the down hall call is $5 + 5 \times 1 = 10$ seconds as shown. These values of the forecast waiting time are displayed by display means disposed in the hall of the individual floors.

Figure 2:
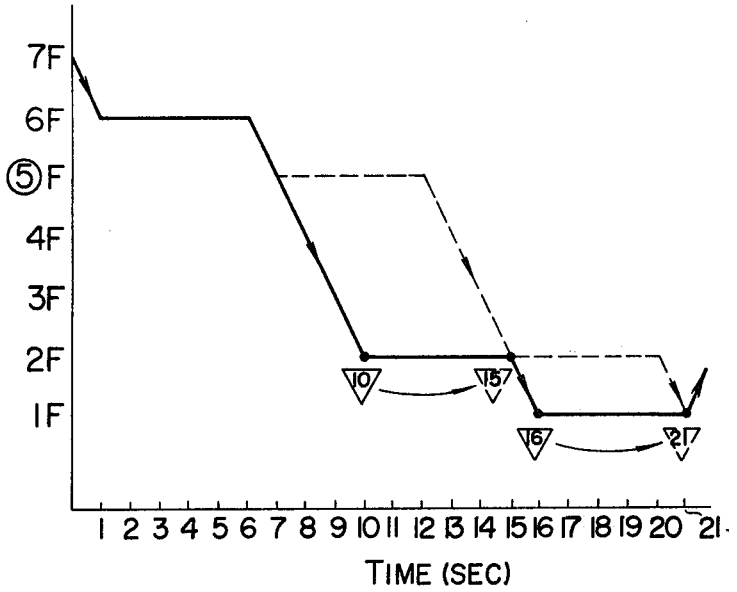
FIG. 2 shows the operating state of the car No. 2 in FIG. 1.

The solid line in FIG. 2 represents the operating state of the car No. 2 when the individual cars operate under the conditions shown in FIG. 1. The car No. 2 leaving the seventh floor arrives at the sixth floor in 1 second, and a passenger or passengers who have registered the sixth floor by cage call registering means get off the car No. 2 at the sixth floor. The car No. 2 starts to move downward from the sixth floor in 6 seconds after it left the seventh floor, since the length of time required for one stop is supposed to be 5 seconds. Then, the car No. 2 runs straight toward the second floor and arrives at the second floor in 10 seconds after it left the seventh floor. The car No. 2 stands still for 5 seconds at the second floor to receive therein a passenger or passengers waiting in the hall of the second floor, and then, it runs toward the first floor. Thus, the car No. 2 arrives at the first floor in 16 seconds after it left the seventh floor. Then, the car No. 2 starts to move upward from the first floor in 21 seconds after it left the seventh floor.

Suppose now that an additional or new down hall call is originated from the fifth floor under the conditions shown in FIG. 1. The values shown in the double circles at the position of the fifth floor in FIG. 1 represent the lengths of time required for the individual cars to serve this new hall call. For example, the length of time required for the car No. 1 to serve this down hall call is $(13 - 5) + 5 \times 3 = 23$ seconds, and that required for the car No. 4 to serve this down hall call is $(13 - 4) + (13 - 5) + 5 \times 2 = 27$ seconds. In the case of the example shown in FIG. 1, the car No. 2 can arrive at the fifth floor earliest of all the cars as it is estimated to arrive at this floor in 7 seconds. Thus, best service can be offered to the passenger or passengers waiting at the landing of the fifth floor when the car No. 2 is selected and this new hall call is allotted to the car No. 2. However, the down hall call originated from the second floor and the up hall call originated from the first floor are allotted already to this car No. 2, and the display means are displaying that the car No. 2 will arrive at the second and first floors in 10 and 16 seconds respectively. Thus, when the down hall call originated from the fifth floor is allotted to the car No. 2, the values of the waiting time above described will naturally be extended by the amount corresponding to the length of time required for the car No. 2 to stop at the fifth floor.

Referring to FIG. 2 again, the operating schedule of the car No. 2 is changed as shown by the broken line as a result of the allotment of this down hall call to the car No. 2. It will be seen from the broken line that the forecast waiting time displayed at the second floor is extended to 15 seconds from the previous value of 10 seconds, and that at the first floor is similarly extended to 21 seconds from the previous value of 16 seconds. Thus, the waiting time which should decrease with the movement of the car toward the instructed floors is extended instead of being shortened, and the passengers waiting in the hall of these floors will become distrustful of the elevator system. Therefore, such undesirable change in the displayed waiting time must be reduced to a minimum.

With a view to minimize such undesirable change, the present invention sets an allowable limit of the number of floors subject to change in displayed waiting time. In the present invention, in response to origination of a new hall call from one of the floors, the number of floors subject to change in displayed waiting time is detected for each of the cars supposing that this new hall call is allotted thereto. Since, in this case, a new down hall call is originated from the fifth floor, the number of floors subject to change in displayed waiting time is zero, two, one, zero and one for the cars Nos. 1, 2, 3, 4 and 5 respectively. The number of floors subject to change in displayed waiting time for each car is compared with the allowable limit so as to select the car or cars which satisfy the condition set forth in the above. When the allowable limit is set to be zero meaning that no change in displayed waiting time is allowable, the cars Nos. 1 and 4 are selected. Out of the cars which meet the condition set forth in the above, the car is selected which provides a minimum change in forecast waiting time at the allotted floors regardless of serving the hall call originated from the fifth floor. Thus, although both the cars Nos. 1 and 4 meet the above condition, the car No. 1 which is estimated to arrive at the fifth floor in 23 seconds is selected.

The desired elevator control can thus be achieved without accompanying any substantial change in the displayed waiting time when the new hall call originated from the fifth floor is allotted to the car No. 1 selected in the manner above described. It is preferred to check as to whether a forecast waiting time excessively longer than a limit is required until the hall call is served by the selected car. When this limit is set at, for example, 30 seconds, the car No. 1 is suitable for serving this specific hall call. However, when this limit is set at, for example, 20 seconds, the car No. 1 is decided to be unsuitable for the service since the length of time required for the car No. 1 to arrive at the fifth floor is estimated to be 23 seconds. In such a case, the allowable limit of the number of floors subject to change in displayed waiting time is increased from the previous setting, and the computation above described is repeated. When, for example, the allowable limit of the number of floors subject to change in displayed waiting time is increased to one from the previous value of zero, the cars Nos. 3 and 5 are newly selected in addition to the previously selected cars Nos. 1 and 4. Among these four cars, the car No. 3 can respond to the hall call originated from the fifth floor earliest of all, because it is estimated to arrive at the fifth floor in 9 seconds as apparent from FIG. 1. The car No. 3 meets also the limit of the forecast waiting time, and the down hall call originated from the fifth floor is allotted to this car No. 3.

In this second example, the allowable limit of the number of floors subject to change in displayed waiting time is increased to one from zero so that the passenger originated the new hall call may not wait excessively long at the fifth floor.

It will be easily understood that the allowable limit of the number of floors subject to change in displayed waiting time may be further increased when earlier service for a new hall call is desired or when, conversely, a car suitable for serving a new hall call without excessively extending the waiting time at the already allotted floors is not easily detected. Further, this allowable limit of the number of floors subject to change in displayed waiting time may be initially suitably set at one, two or more instead of zero depending on the traffic demand and other factors. Further, this allowable limit may also be increased so that a suitable car can be searched when none of the cars fail to meet the condition set forth in the above.

Figure 3:
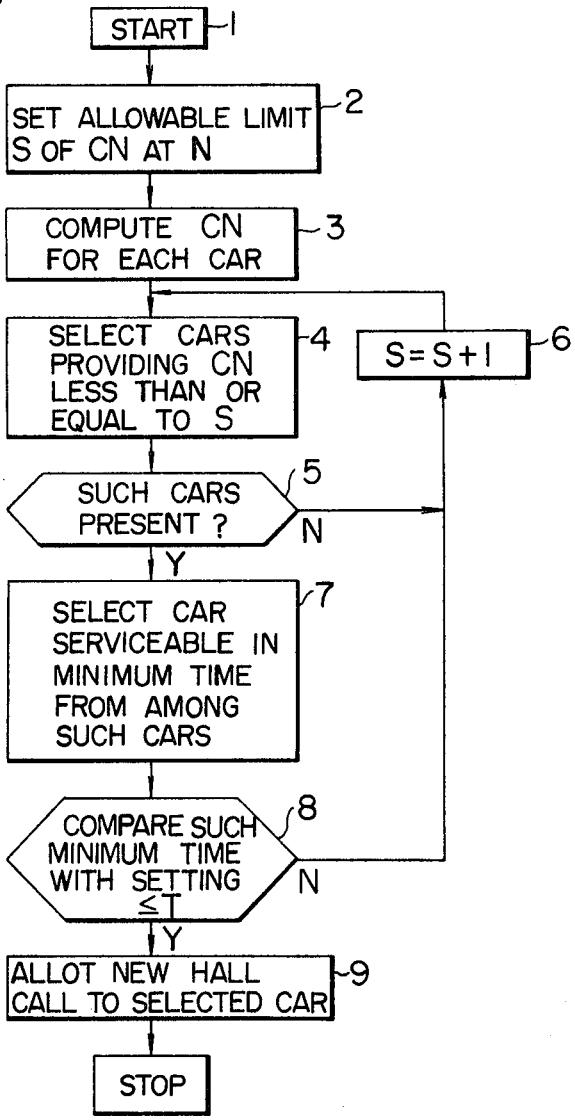
FIG. 3 is a general flow chart for illustrating the manner of control in the elevator car group control system according to the present invention.

FIG. 3 is a general flow chart of control carried out in an embodiment of the present invention.

Computation as shown in FIG. 3 is started in response to origination of a new hall call from one of the floors. In block 2, the allowable limit S of the number of floors CN subject to change in displayed waiting time is initially set at a predetermined value N. As described before, this allowable limit S is used so as to select a car most suitable for serving a new hall call originating floor from among a group of cars for which the number of floors subject to change in displayed waiting time is less than or equal to S.

Figure 4:
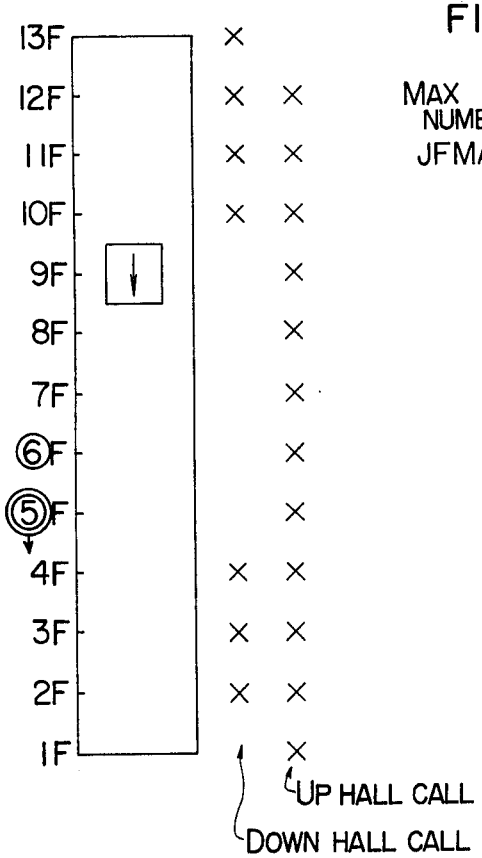
FIG. 4 is a diagrammatic view for illustrating the manner of detecting the number of floors subject to change in displayed waiting time when a new hall call is originated and allotted to a car in addition to hall calls allotted already.

In block 3, the number of floors CN subject to change in displayed waiting time is computed for each of the cars. Referring to FIG. 4, one of the cars is shown located at the ninth floor for downward movement, and a new down hall call is originated from the fifth floor. The number of floors CN subject to change in displayed waiting time is represented by the number of hall calls allotted already to this car among hall calls originated from the floors lying intermediate between the fifth floor and the present physical position of this car along the moving direction thereof. In the case of FIG. 4, one or more of down hall calls originated from the second, third, fourth, 10th, 11th, 12th and 13th floors and one or more of up hall calls originated from the first, second, third, fourth, fifth, sixth, seventh, eighth, ninth, 10th, 11th and 12th floors may be allotted already to this car, and the number of floors subject to change in displayed waiting time is represented by the number of such hall calls allotted already to this car.

In block 4, the car or cars are selected when this number of floors subject to change in displayed waiting time is found to be less than or equal to S. In the case of the example shown in FIG. 1, the cars Nos. 1 and 4 are selected when $S = 0$, while the cars Nos. 1, 3, 4 and 5 are selected when $S = 1$. In block 5, confirmation is made as to whether the selection of a car or cars satisfying the condition $CN \leqq S$ has been successful. When the result indicates that none of such cars are selected, unity is added to the value of S in block 6, and the operation carried out in the block 4 is repeated again using S which now given by $S = S + 1$. It is apparent that at least one car satisfying the condition of selection specified above can necessarily be selected in the block 4 when S is selected to be a very large value. Therefore, all the cars can be selected in the block 4 when N in the block 2 is set at a very large value. Thus, the method of allotting a new hall call to one of the cars in the present invention is the same in result as the prior art method in which a new hall call originated from a floor is allotted to a car which can arrive at this floor in a minimum length of time.

In block 7, the car which can arrive at the new hall call originating floor in a minimum length of time is selected from among the group of cars selected in the block 4. In the case of the example shown in FIG. 1, the car No. 1 is selected out of the cars Nos. 1 and 4 selected in the block 4 when $S = 0$, since this car No. 1 can arrive at the fifth floor to serve the down hall call in 23 seconds without increasing the number of floors subject to change in displayed waiting time. When $S = 1$, the car No. 3 is selected from among the cars Nos. 1, 3, 4 and 5 to serve the down hall call originated from the fifth floor, since this car No. 3 can arrive at the fifth floor in a minimum length of time of 9 seconds.

In block 8, the length of time required for the car selected in the block 7 to arrive at the hall call originating floor is compared with a predetermined time setting T. When the above length of time is longer than the predetermined time setting T, unity is added to the value of S, and the operation carried out in the block 4 is repeated using this value of S. When the above length of time is shorter than the predetermined time setting T, the down hall call is allotted to the car selected in the block 7, and allotment of this new hall call is completed.

Figure 5:
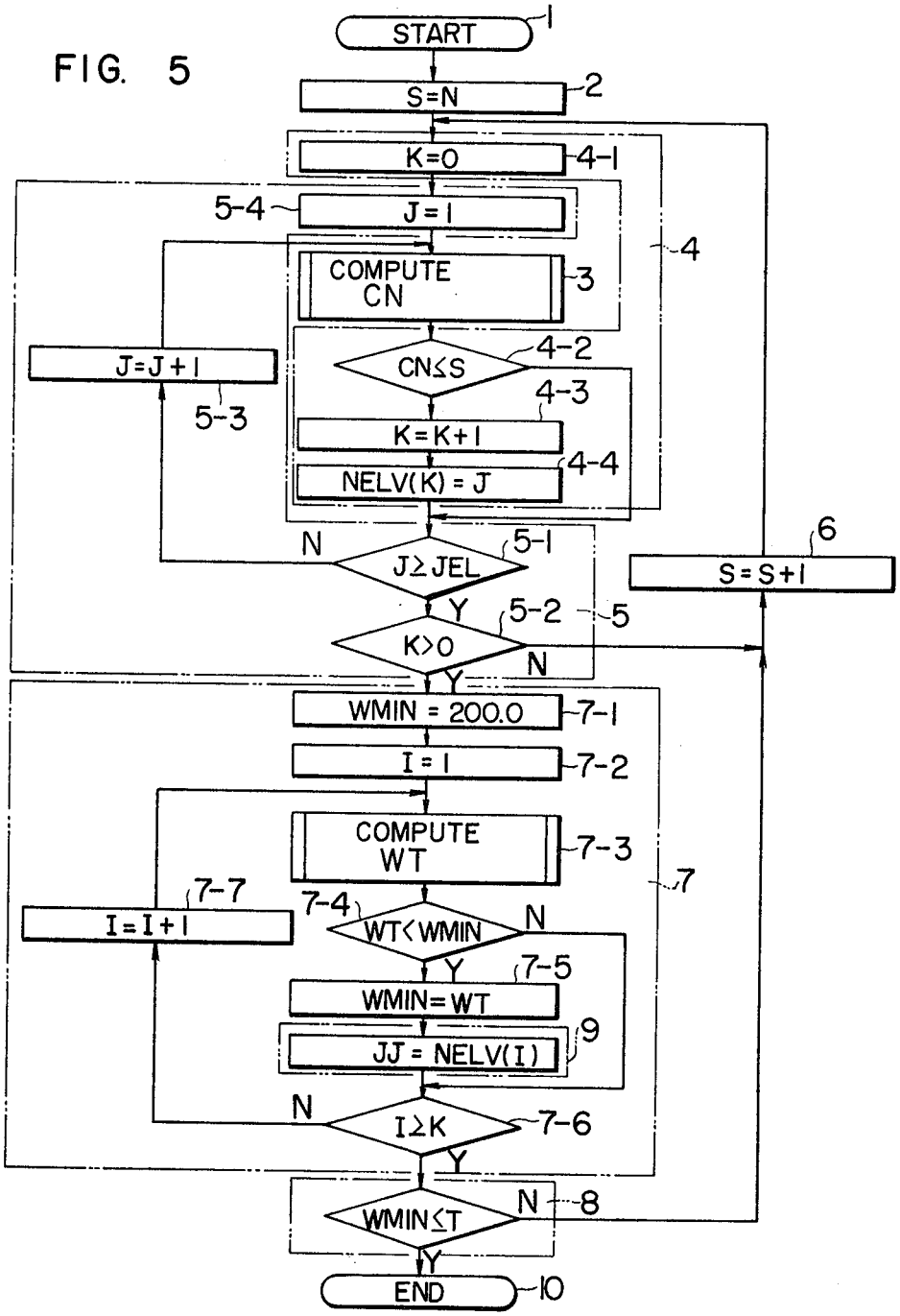
FIG. 5 is a detailed flow chart for illustrating the general flow of control in an embodiment of the control system according to the present invention.

FIG. 5 is a detailed flow chart to illustrate in further detail the operation carried out in the blocks in the general flow chart of the present invention shown in FIG. 3.

In block 2, the allowable limit S of the number of floors CN subject to change in displayed waiting time is set at a predetermined value N as described with reference to FIG. 3. In block 3, the number of floors CN subject to change in displayed waiting time is computed according to a modulated program. Application of this program to the case of the example shown in FIG. 1, for instance, gives the results that $CN = 0$ for the cars Nos. 1 and 4, $CN = 1$ for the cars Nos. 3 and 5, and $CN = 2$ for the car No. 2. This program will be described in detail later.

In block 4, the number of floors CN subject to change in displayed waiting time, obtained by the computation in the block 3, is compared with the allowable limit set in the block 2 so as to select cars satisfying the condition CN ≦ S. In block 4 - 4, these selected cars are recorded on a name table NELV(K). Further, the number K of the selected cars is counted by a K counter in block 4-3. More precisely, the value of K is initially set at zero in block 4-1. In block 4-2, the value of CN obtained by the computation in the block 3 is compared with the allowable limit S, and when CN ≦ S, K is counted up in block 4-3. The car number J of the car satisfying the above condition CN ≦ S is recorded as NELV(K) on the name table NELV. In FIG. 5, the symbol = is used to indicate that the value of the right-hand side member is set in the table at the left-hand side.

In block 5, computation similar to that carried out in the blocks 3 and 4 is applied to each of all the cars arranged for parallel operation. The total number of the cars arranged for parallel operation is defined as JEL herein. Further, in this block 5, selection of ione or more cars satisfying the relation CN ≦ S is confirmed. Describing in more detail, the car number J is initially set at one in block 5-4, and computation similar to that carried out in the blocks 3 and 4 is applied to the car No. 1. In block 5-1, the car number J is compared with JEL representing the total number of the cars. In this manner, computation similar to that carried out in the blocks 3 and 4 is applied to all the cars until the value of J becomes equal to that of JEL while successively adding unity to J in block 5-3. In block 5-2, selection of one or more cars satisfying the relation CN ≦ S is confirmed on the basis of the results of the computation applied to all the cars in the manner above described. That is, the count K stored in the block 4-3 is compared with zero in the block 5-2. When none of the cars found satisfying the above condition, that is, when the result of comparison is "No," unity is added to the value of the allowable limit S in block 6, and computation similar to that carried out in the blocks 3, 4 and 5 is repeated. With the successive increase of the value of S, the condition set forth in the block 4-2 is relaxed correspondingly, and the number of suitable cars is increased accordingly. In the case of the example shown in FIG. 1, all the cars can be selected when the predetermined value N is previously set at a large value, for example, N = 5. On the other hand, when the result of comparison in the block 5-2 is "Yes", computation in block 7 is started.

In this block 7, computation is carried out to seek the length of time WT required for each of the cars, selected as a result of the computation carried out in the blocks 3, 4 and 5, to arrive at the new hall call originating floor, and the car which can arrive at this floor in a minimum length of time is selected from among these cars. In block 7-1, a predetermined minimum time setting WMIN of considerably large value is used. In block 7-4, the length of time WT required for arrival computed in block 7-3 is compared with this minimum time setting WMIN. When the result of comparison in the block 7-4 proves that WT < WMIN, this value of WT is employed as WMIN in block 7-5. Therefore, when similar computation is carried out on all the selected cars in blocks 7-2, 7-6 and 7-7, the car which can arrive at the specific floor in the newly determined minimum length of time WMIN can be detected in the block 7-5, and this car is recorded on a table JJ in block 9. The manner of computation of WT in the block 7-3 will be described in detail later.

In block 8, the minimum length of time WMIN required for arrival is compared with a predetermined time setting T, and the computation in FIG. 5 is completed when WMIN ≦ T. On the other hand, when WMIN > T, unity is added to the value of S in the block 6, and the operation so far described is repeated to search for a most suitable car again.

According to the present invention, a car which is most suitable for serving or responding to a new hall call is selected in a manner as above described. In other words, the car recorded on the table JJ in the block 9 at the end of the computation carried out in FIG. 5 is the one which is most suitable for responding to the specific new hall call, and the length of time required WT for the selected car to arrive at the specific floor (the forecast waiting time in the case of a passenger or passengers waiting in the hall of the specific floor) is stored in the block 7-5. Therefore, this specific new hall call is allotted to the car selected to be most suitable for responding to this hall call. Further, the length of time WT required for the selected car to arrive at the specific floor is displayed at the floor landing of this floor to inform the forecast waiting time for the passenger or passengers waiting the arrival of the responding car. Thus, the passenger or passengers waiting in the hall of the specific floor can know that the car selected from among the plurality of cars arrives at the floor in the displayed length of time.

It will be seen from the above description that, according to the present invention, the car which provides a smaller number of floors subject to change in displayed waiting time than the others can be always selected to respond to a new hall call. Further, according to the present invention, it is possible to select the car which can serve such hall call earlier than the others.

The computation carried out in various blocks of FIG. 5 will be described in further detail with reference to FIGS. 6 to 15.

Figure 6:
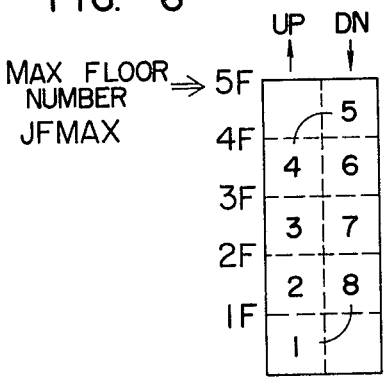
FIG. 6 is a diagrammatic view for illustrating the floor notation employed in the programming according to the present invention.
Figure 7:
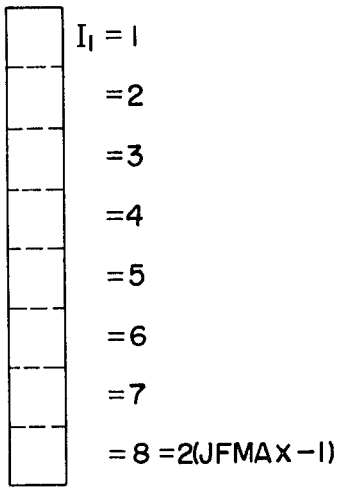
FIG. 7 illustrates the floors numbered according to the floor notation shown in FIG. 6.

FIGS. 6 and 7 illustrate the type of programming applied to the building for the purpose of computation of the number of floors CN subject to change in displayed waiting time and computation of the length of time WT required for arrival. In FIG. 6, the building is shown as having five floors for simplicity of illustration, and two cars are arranged for parallel operation for serving the 1st to 5th floors. The symbol JFMAX is used to denote the maximum number of floors which is five herein, and the floors are numbered continuously in the order of from up to down in the program as shown. For example, the second floor is numbered 2 and 8 respectively when an up hall call and a down hall call appear therefrom, and similarly the fourth floor is numbered 4 and 6 respectively when an up hall call and a down hall call appear therefrom. Therefore, the maximum floor interval is given by 2·(JFMAX−1). The building of FIG. 6 may be illustrated in a form as shown in FIG. 7, and the maximum floor interval 2·(JFMAX−1) = 8 in this case.

Figure 8:
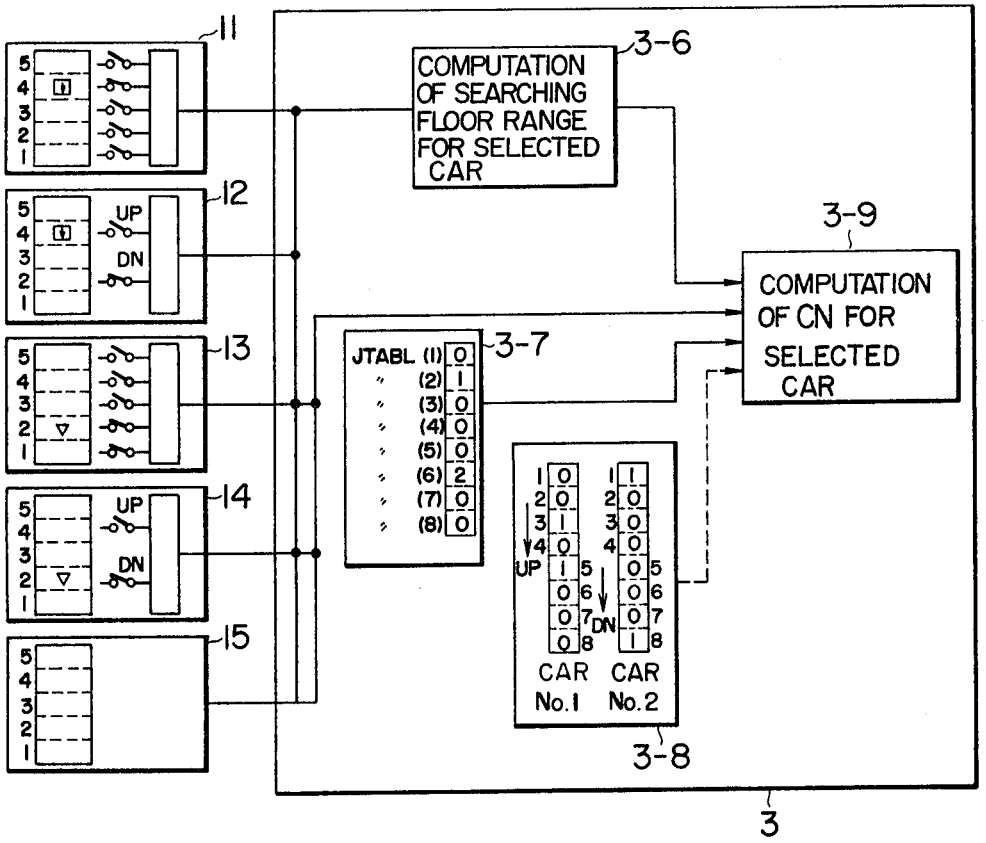
FIG. 8 is a block diagram of means employed in the embodiment for computing the number of floors subject to change in displayed waiting time when a new hall call is allotted to a specific car.

FIG. 8 is a block diagram of means used in the block 3 for computing the number of floors CN subject to change in displayd waiting time. Referring to FIG. 8, the reference numerals 11, 12, 13, 14 and 15 designate respectively means for generating a car position signal, means for generating a car direction signal, means for generating a hall call signal, means for generating a hall call direction signal, and means for generating a maximum floor number signal. It is commonly known in the art of elevator car group control that these signals can be easily obtained.

In block 3-6, the searching floor range for the selected car is computed in the manner described with reference to FIG. 4. In block 3-7, hall calls allotted to the cars are recorded on a table JTABL. In block 3-8, forecast target floors for passengers waiting in the hall of some of the floors are preset in tables corresponding to the respective cars. In block 3-9, the number of floors CN subject to change in displayed waiting time is computed for the selected car.

In block 3-7, hall calls allotted already to the cars are recorded on the table JTABL as above described. In the illustrated example, an up hall call originated from the second floor is allotted to the car No. 1, and a down hall call originated from the fourth floor is allotted to the car No. 2. It will be seen that zero is recorded on each of the portions of the table JTABL corresponding to the floors from which no hall calls are originated. In block 3-8, unity is recorded on each of the portions corresponding to the third and fifth floors in the table associated with the car No. 1 since it is forecast that the passengers originating the up hall call from the second floor and waiting in the hall of the second floor may register cage calls for the third and fifth floors after getting on the car No. 1. Zero is recorded on the other portions of this table. Similarly, unity is recorded on each of the portions corresponding to the second and first floors in the table associated with the car No. 2 since it is forecast that the passengers originating the down hall call from the fourth floor and waiting in the hall of the fourth floor may register cage calls for the second and first floors after getting on the car No. 2. Various methods have been proposed hitherto for forecasting target floors designated by cage calls registered by passengers getting on cars. For instance, the target floors for the passengers waiting in the hall of the hall call originating floors are forecast on the basis of the data obtained in the past and according to the number of predictive passengers. However, the practical method of forecasting the target floors will not be described herein as it is not the subject matter of the present invention, and description will proceed assuming that the results of forecast target floors are recorded already on the tables.

Information necessary for the computation of the searching floor range for the selected car in block 3-6 includes the car position, moving direction of the car, new hall call originating floor, up or down hall call, and number of floors of the building. Information necessary for the computation of the number of floors CN subject to change in displayed waiting time in block 3-9 includes the searching floor range computed in the block 3-6, new hall call originating floor, up or down hall call, number of floors of the building, already allotted hall calls recorded on the table in the block 3-7, and forecast target floors recorded on the tables in the block 3-8. However, the memory of the tables recording the forecast target floors for the passengers waiting in the hall of the hall call originating floors will not be used in the later description for ease of understanding.

Figure 9:
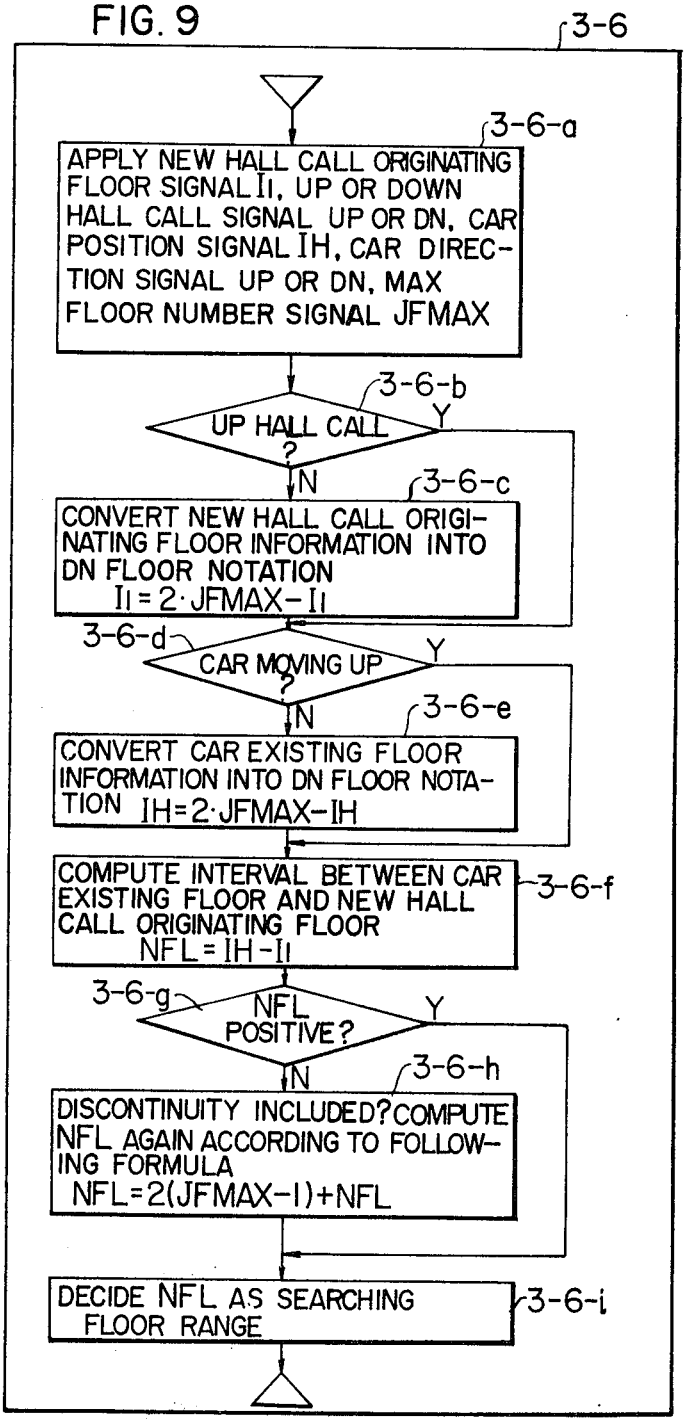
FIG. 9 is a flow chart of part of FIG. 8 for illustrating the manner of computing the searching floor range for the specific car in response to the origination of the new hall call.

FIG. 9 is a flow chart to illustrate how the searching floor range for the selected car is computed in the block 3-6 in FIG. 8. In block **3-6-*a*, information inputs necessary for the computation are applied. These information inputs include a new hall call originating floor signal $I_1$, an up or down hall call signal UP or DN, a car position or car existing floor signal IH, a car direction signal UP or DN, and a maximum floor number signal JFMAX. Then, in blocks 3-6-*b* and 3-6-*c*, the new hall call originating floor information is converted into the floor notation employed in the program described with reference to FIG. 6. For example, the result of decision in the block 3-6-*b* is "Yes" when a new up hall call is originated from the third floor in FIG. 6, and in this case, the floor notation of this third floor is not changed. On the other hand, when a new down hall call is originated from the third floor, the result of decision in the block 3-6-*b* is "No", and the floor notation corresponding to the origination of a down hall call from the third floor is used at this time. In this case, processing as shown in the block 3-6-*c* is carried out. The result of this processing is given by $I_1 = 2 \cdot JFMAX - I_1 = 2 \times 5 - 3 = 7$. The symbol = is used to mean that the value at the right-hand side is set in the table at the left-hand side, and the same applies to all the expressions described hereinafter. The car existing floor is similarly processed in blocks 3-6-*d* and 3-6-*e***.

Then, the floor interval NFL between the new hall originating floor $I_1$ and the car existing floor IH is computed in block **3-6-*f***. Thus, NFL is expressed as $$NFL = IH - I_1$$

The polarity of the value of NFL thus obtained is detected in block **3-6-*g*, and when NFL is positive, this value of NFL gives the searching floor range. On the other hand, when the value of NFL is negative, processing as shown in block 3-6-*h*** must be carried out since the searching floor range includes the discontinuous point at which the moving direction of car is changed from down to up. In this case, NFL is given by $$NFL = 2 \cdot (JFMAX - 1) + NFL.$$

In the case of FIG. 4, for example, the car existing floor IH on the program is given by $$IH = 2 \times 13 - 9 = 17,$$

and similarly, the new hall call originating floor $I_1$ is given by $$I_1 = 2 \times 13 - 5 = 21.$$

Therefore, the value of NFL computed in the block **3-6-*f*** is now given by $$NFL = IH - I_1 = 17 - 21 = -4,$$

and it is necessary to carry out processing as shown in the block **3-6-*h* since the value of NFL is negative. As a result of a processing in this block 3-6-*h***, NFL is now given by $$NFL = 2 \cdot (JFMAX - 1) + NFL = 2 \cdot (13 - 1) - 4 = 20,$$

and this means that the searching floor range includes 20 floors.

Figure 10:
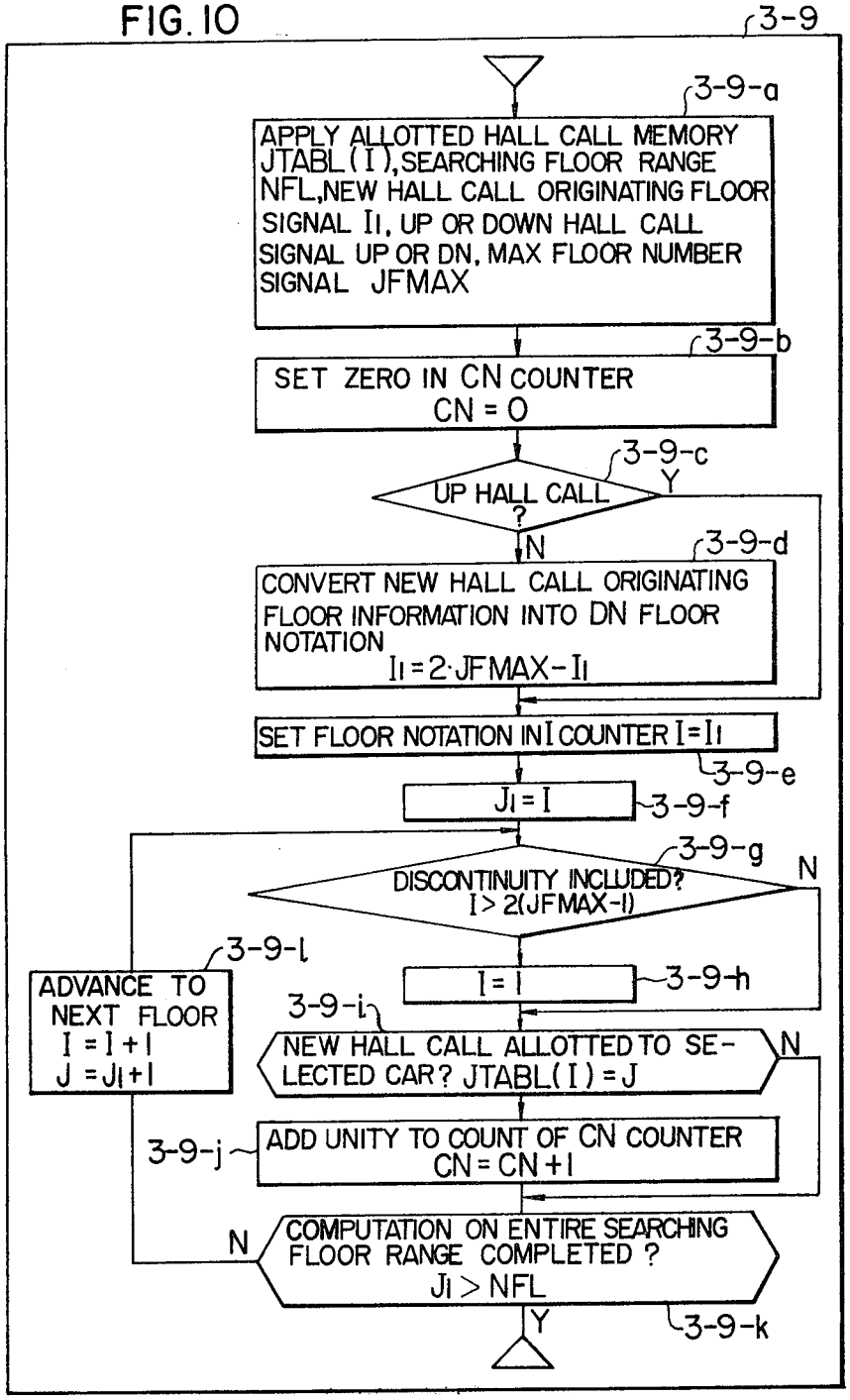
FIG. 10 is a flow chart of part of FIG. 8 for illustrating the manner of computing the number of floors subject to change in displayed waiting time due to allotment of the new hall call to the specific car.

FIG. 10 is a floor chart used for the computation of the number of floors CN subject to change in displayed waiting time associated with the selected car. In block **3-9-*a*, information inputs necessary for the computation are applied. These information inputs include the memory JTABL(I) of the allotted hall call table JTABL, the searching floor range NFL, the new hall call originating floor signal $I_1$, the up or down hall call signal UP or DN, and the maximum floor number signal JFMAX. In block 3-9-*b*, a counter for counting CN is initially set at zero. In blocks 3-9-*c* and 3-9-*d*, processing similar to that carried out in the blocks 3-6-*b* and 3-6-*c* in FIG. 9 is done for converting the new hall call originating floor information into the floor notation used in the program. In block 3-9-*e*, this floor notation is set in an I counter. In block 3-9-*f*, a $J_1$ counter is set at unity. This $J_1$ counter counts the number of searched floors. In blocks 3-9-*g* and 3-9-*h*, processing is carried out to find whether the floor notation stored in the I counter includes the discontinuous point at which the moving direction of the car changes from down to up. In block 3-9-*i*, allotment of the new hall call to the selected car is detected. That is, the identity between the corresponding memory JTABL(I) of the allotted hall call table JTABL and the number J of the selected car is detected, and when the identity is proved, unity is added to the count of the CN counter in block 3-9-*j* since this new hall call is allotted to the selected car. When the identity is not detected, a jump from block 3-9-*i* to block 3-9-*k* occurs. In blocks 3-9-*k* and 3-9-*l*, computation similar to that above described is carried out on all the floors lying in the searching floor range. Computation in the block 3-9-*k*** is ceased when $J_1$ exceeds NFL and provides the relation $J_1 > NFL$. The count of the CN counter at this time indicates the number of floors CN subject to change in displayed waiting time within the searching floor range.

Figure 11:
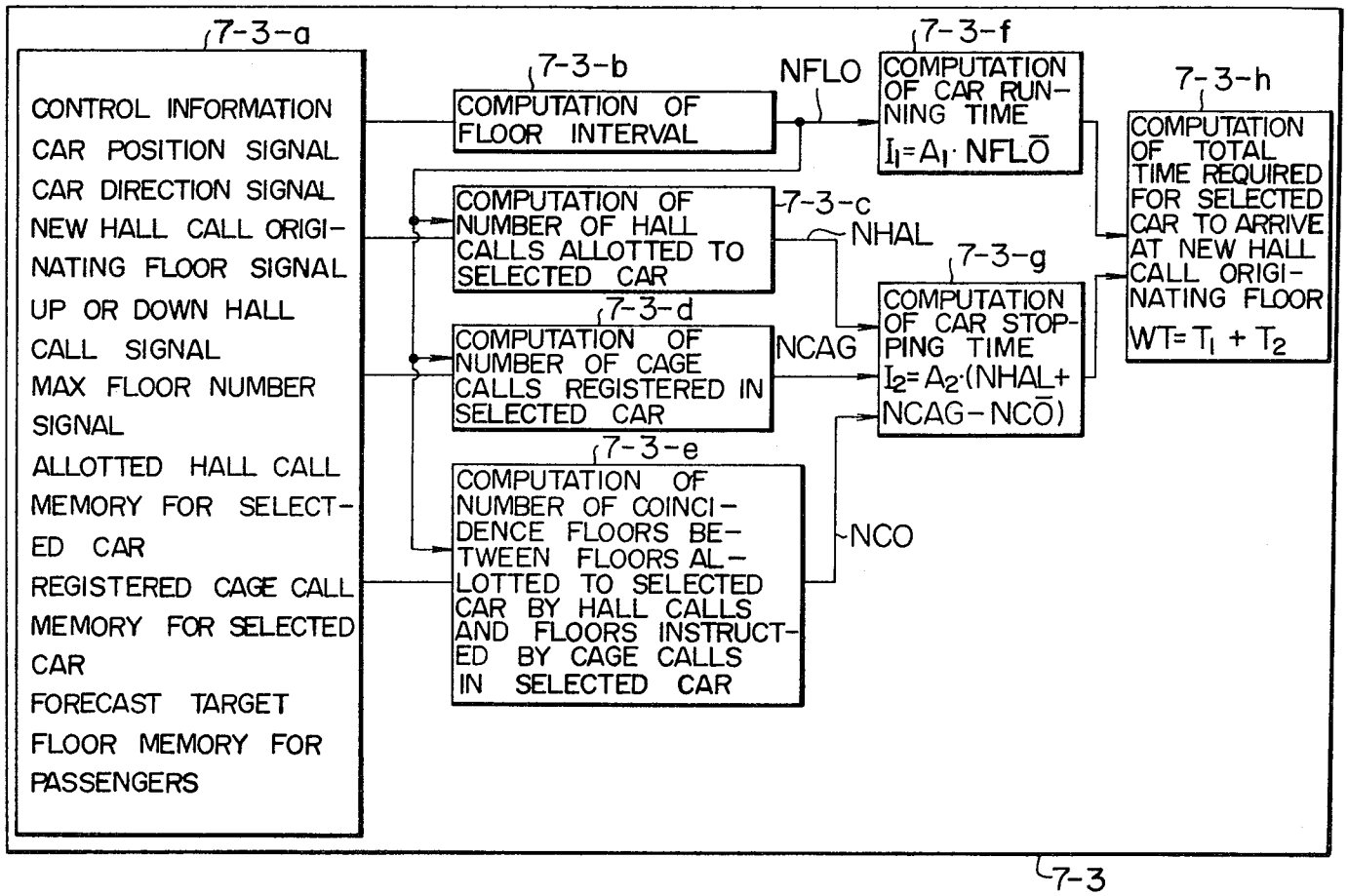
FIG. 11 is a block diagram of means employed in the embodiment for computing the length of time required for the specific car to arrive at the new hall call originating floor.

FIG. 11 is a block diagram of means for computing the length of time WT required for the selected car to arrive at a new hall call originating floor. Various control information inputs shown in block **7-3-*a* are similar to those used in 11 to 15 and 3-6 to 3-8 in FIG. 8. In this case, however, a table similar to that shown in the block 3-8 in FIG. 8 is additionally required for memorizing cage calls registered in the selected car. Unity is recorded on this table when a cage call is registered in the selected car, while zero is recorded when no cage call is registered. In block 7-3-*b*, the number of floors NFLO lying between the selected car existing floor and the new hall call originating floor is computed. In block 7-3-*c*, the number of hall calls NHAL allotted to the selected car within the above floor range is computed. In block7-3-*d*, the number of cage calls NCAG registered in the selected car within the above floor range is computed. In block 7-3-*e*, the number of coincidence floors NCO between the hall call originating floors allotted to the selected car and the target floors registered by the cage calls in the selected car within the above floor range is computed. In block 7-3-*f*, the length of time $T_1$ required for the selected car to arrive at the new hall call originating floor without stopping is computed. In block 7-3-*g*, the length of time $T_2$ required for the selected car to stop at the successive instructed floors before reaching the new hall call originting floor is computed. In block 7-3-*h***, the total length of time WT required for the selected car to arrive at the new hall call originating floor is computed.

Figure 12:
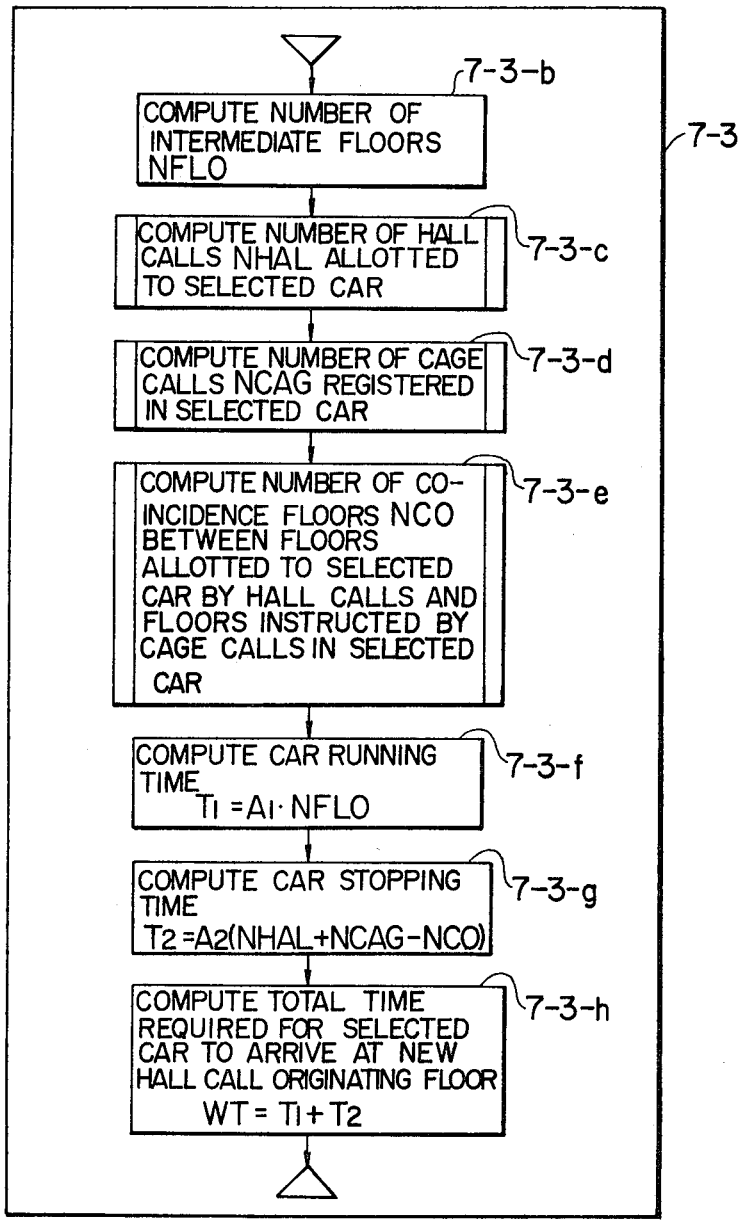
FIG. 12 is a flow chart of FIG. 11 for illustrating the manner of computing the length of time required for the specific car to arrive at the new hall call originating floor.

FIG. 12 shows the main flow for the computation of the length of time WT. In block **7-3-*b*, the number of floors NFLO lying between the selected car existing floor and the new hall call originating floor is computed. In block 7-3-*c*, the number of hall calls NHAL allotted to the selected car within the above floor range is computed. In block 7-3-*d*, the number of cage calls NCAG registered in the selected car within the above floor range is computed. In block 7-3-*e*, the number of coincidence floors NCO between the hall call originating floors allotted to the selected car and the target floors registered by the cage calls in the selected car within the above floor range is computed. Then, in block 7-3-*f***, the length of time $T_1$ required for the selected car to arrive at the new hall call originating floor without stopping is computed. This length of time $T_1$ is given by $T_1 = A_1 \cdot NFLO$ *where* $A_1$ is the length of time required for the car to run one floor interval. In block **7-3-*g***, the length of time $T_2$ required for the selected car to stop at the successive instructed floors before arriving at the new hall call originating floor is computed. This length of time $T_2$ is given by $$T_2 = A_2 \cdot (NHAL + NCAG - NCO)$$

where $A_2$ is the length of time required for the car to make one stop. Therefore, the total length of time WT required for the selected car to arrive at the new hall call originating floor is given by $$WT = T_1 + T_2$$

as shown in block **7-3-*h*. The computation carried out in the blocks 7-3-*c*, 7-3-*d* and 7-3-*e* will be described in further detail with reference to FIGS. 13 to 15** respectively. However, information concerning forecast target floors which may be registered by cage calls by waiting passengers are not taken into consideration herein for simplicity of description.

The computation carried out in the block **7-3-*b* in FIG. 12 is based on a principle similar to that used in the computation of the searching floor range in FIG. 9. Therefore, the value of NFLO can be computed by merely replacing NFL in the block 3-6-*f* in FIG. 9 by NFLO and modifying the computing formula in the block 3-6-*f*** as follows:

$$NFLO = I_1 - IH$$

Figure 13:
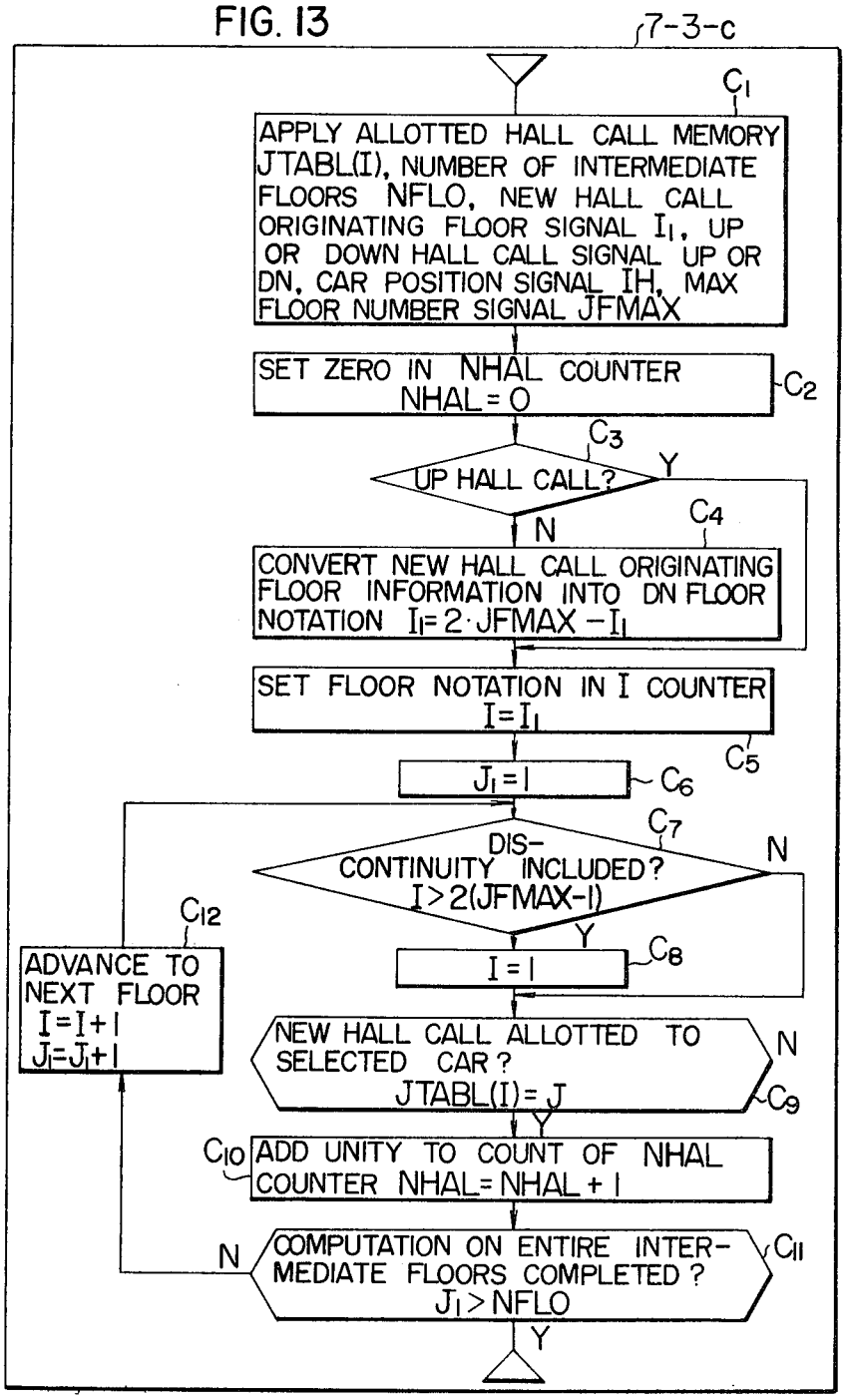
FIG. 13 is a flow chart of part of FIG. 12 for illustrating the manner of computing the number of hall calls allotted to the specific car.

FIG. 13 is a flow chart showing in detail the computation carried out in the block **7-3-*c* in FIG. 12. The principle of computation is similar to that described with reference to the block 3-9 in FIG. 10. Therefore, for simplicity of description, the portions different from those referred to already with reference to FIG. 10** will merely be described to avoid repetition of the same description.

In FIG. 10, the number of floors CN subject to change in displayed waiting time (that is, the number of hall calls subject to delayed service) is computed, but in FIG. 13, the number of hall calls NHAL allotted to the selected car is computed within the floor range between the car existing floor and a new hall call originating floor. However, the computation in FIG. 13 is similar to that in FIG. 10 in that the number of hall calls is computed in both these cases. Therefore, the number of hall calls allotted to the selected car can be computed in FIG. 13 by merely replacing CN in FIG. 10 by NHAL as shown.

Figure 14:
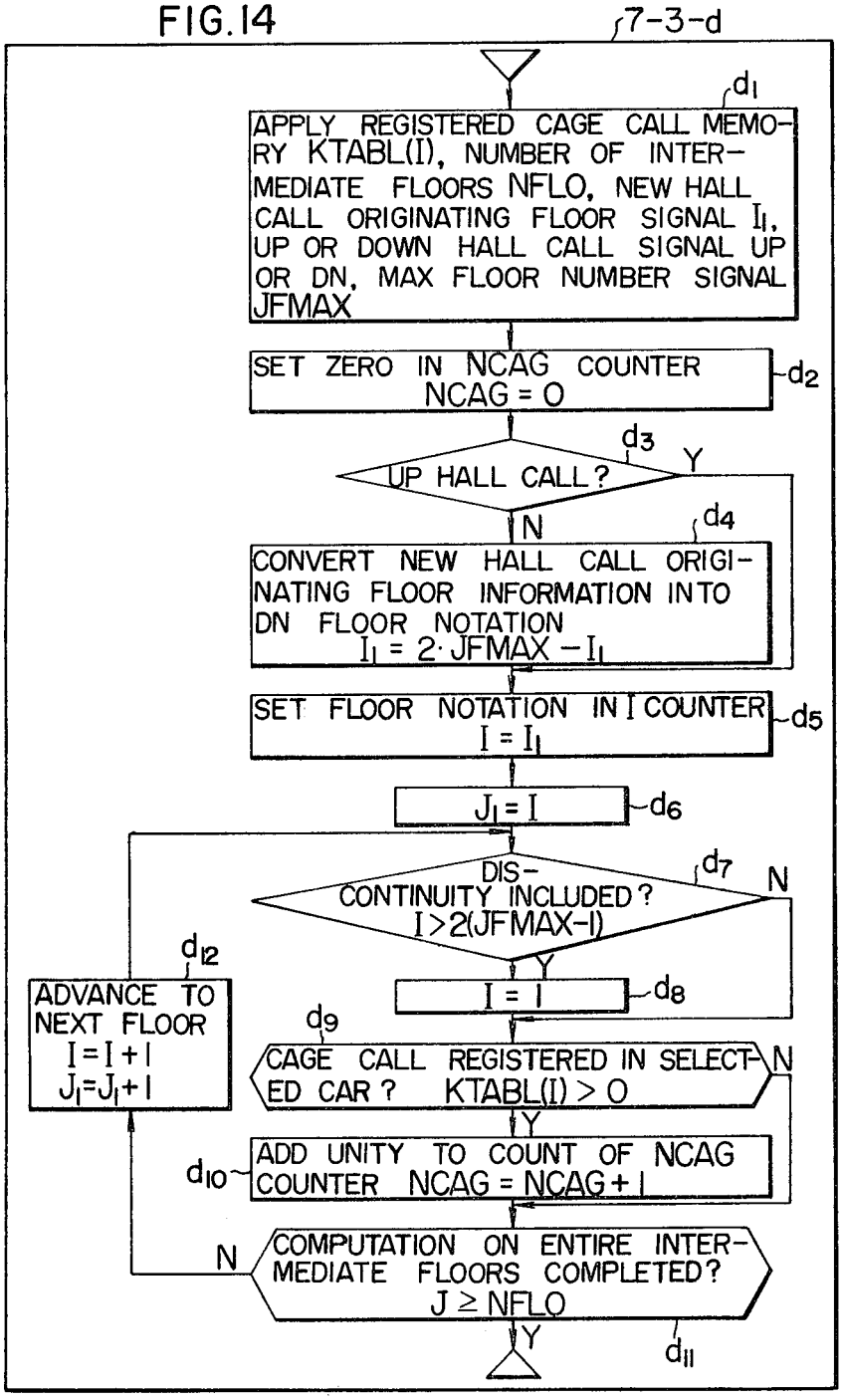
FIG. 14 is a flow chart of part of FIG. 12 for illustrating the manner of computing the number of cage calls registered in the specific car.

FIG. 14 is a flow chart showing in detail the computation carried out in the block **7-3-*d* in FIG. 12 for seeking the number of cage calls NCAG registered in the selected car. FIG. 14 is similar to FIG. 13 in the basic pattern of computation, but differs from the latter in that the memory KTABL(I) of the registered cage call table KTABL is applied as an input in block $d_1$ in lieu of the memory JTABL(I) of the allotted hall call table JTABL in block $c_1$, and a counter for counting the number of cage calls NCAG is used in block $d_2$ in lieu of the NHAL counter in block $c_2$. Further, FIG. 14 differs from FIG. 13** in the decisions made in blocks $d_9$ and $d_{10}$. The result of processing in the block $d_9$ is "Yes" when unity is recorded on the cage call table KTABL indicating that the corresponding cage call is registered in the selected car, and unity is added to the count of the NCAG counter in the block $d_{10}$.

On the other hand, when the result of processing in the block $d_9$ is "No," a jump from block $d_9$ to block $d_{11}$ occurs. Therefore, the content of the NCAG counter in the block $d_{10}$ represents the number of cage calls NCAG registered in the selected car.

Figure 15:
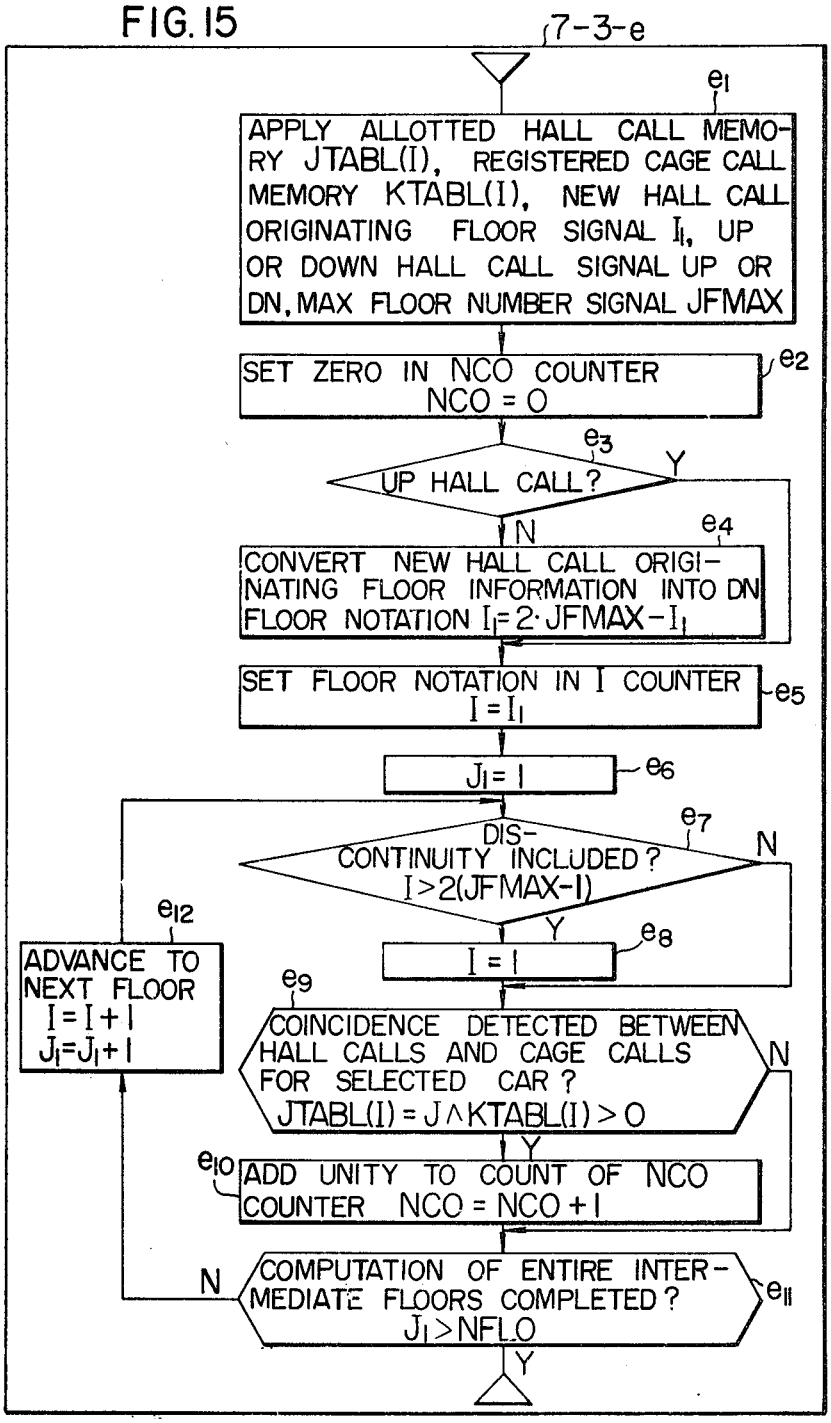
FIG. 15 is a flow chart of part of FIG. 12 for illustrating the manner of computing the number of coincidence floors between the floors allotted to the specific car by the hall calls and the floors instructed by the cage calls in the specific car.

FIG. 15 is a flow chart showing in detail the computation carried out in the block 7-3-e in FIG. 12. FIG. 15 is similar to FIG. 13 in the basic pattern of computation, but differs from the latter in that the memory KTABL(I) of the registered cage call table KTABL is applied as an input in block $e_1$ in addition to the memory JTABL(I) of the allotted hall call table JTABL, and a counter for counting the number of coincidence floors NCO is used in block $e_2$ in lieu of the NHAL counter in block $c_2$. Further, FIG. 15 differs from FIG. 13 in the decisions made in blocks $e_9$ and $e_{10}$. In the block $e_9$ in FIG. 15, the logical product of $JTABL(I) = J$ and $KTABL(J, I) > 0$ is sought so as to detect the coincidence of the new hall call allotted to the selected car and the cage call corresponding to this new call hall and registered already in the selected car. When the result of processing is "Yes," the count of the NCO counter is increased by unity, while when the result is "No," a jump from block $e_9$ to block $e_{11}$ occurs. Therefore, the content of the NCO counter represents the number of coincidence floors. While a preferred manner of computing the length of time WT required for the selected car to arrive at the new hall call originting floor has been described, it is apparent that the originating length of time WT can be computed with improved precision when information representative of forecast target floors for passengers waiting in the hall of hall call originating floors is used as an additional input.

Various processing stages processed by a computer have been described in detail in the foregoing. It will be seen that a car selected to be most suitable for serving a new hall call responds to this new hall call and arrives at the new hall call originating floor. Means for stopping the serving car at the instructed floor are commonly known in the art, and any detailed description is unnecessary.

It will be understood from the foregoing detailed description that the present invention is applied to an elevator car group control system for controlling a plurality of cars arranged for parallel operation for serving a plurality of service floor landings of a building in response to hall calls, in which one of the cars is selected in response to the origination of a new hall call so as to serve this new hall call, and the length of time required for the selected car to arrive at the specific floor in response to this new hall call is forecast and displayed at the landing of the new hall call originating floor. According to the present invention, a most suitable car is selected so as to minimize the number of floors subject to change in forecast waiting time displayed already as a result of allotment of the hall calls therefrom to the car. Therefore, it is possible to minimize the possibility of chaning the forecast waiting time displayed already at the landing of these floors, and improved service can be offered to passengers waiting in the hall of these floors.

Further, according to the present invention, the length of time required for the cars for serving all the halls calls originated from the floors can be substantially uniformalized and shortened, and the passengers need not wait for an excessively long time until they can get on the cars. For example, in the case of FIG. 1, a down hall call originated from the fifth floor is allotted to the car No. 1 according to the present invention when the allowable limit of the number of floors subject to change in displayed waiting time is set at zero. On the other hand, according to the prior art practice, this down hall call is allotted to the car No. 2 since this car can serve the down hall call earlier than the car No. 1. It is true that the car No. 2 is more suitable for the service than the car No. 1 when the down hall call originated from the fifth floor is solely taken into consideration. However, allotment of the down hall call originated from the fifth floor to the car No. 2 results not only in an inevitable change in the waiting time displayed already at the second and first floors but also in an undesirable delay in the service by the time corresponding to the length of time required for the car No. 2 to stop at the fifth floor. For example, a total delay of 10 seconds occurs in the service for the hall calls originated already from the second and first floors when a length of time of 5 seconds is required for one stop. However, according to the present invention, the other hall calls can be served without any delay when the car No. 1 is selected to serve the down hall call originated from the fifth floor. Thus, uniform and early service can be offered to all the hall calls. Further, extremely bad service for the hall calls can be avoided due to the fact that the manner of control is such that anyone of the hall caslls can be served always within an allowable waiting time.

In the embodiment of the present invention described by way of example, the cars, for which the number of floors subject to change in displayed waiting time is less than or equal to a predetermined setting, are detected in response to the origination of a new hall call, and then, the car providing a shorter forecast waiting time than the others is selected from among the detected cars to be decided to respond to the new hall call. However, the present invention is in no way limited to such specific embodiment, and the fundamental technical idea of the present invention, that is, preferential selection of a car providing a smaller number of floors subject to change in displayed waiting time than others may be suitably applied to control systems of this kind. In a modification, the cars which provide a forecast waiting time shorter than a predetermined setting are initially detected in response to the origination of a new hall call, and then, the car providing a smaller number of floors subject to change in displayed waiting time than the others is selected from among the detected cars to respond this new hall call. According to this modification, the service for the new hall call may be delayed slightly compared with that in the embodiment above described, but the probability of selecting the car providing a smaller number of floors subject to change in displayed waiting time can be improved.

What is claimed is:

1. An elevator car group control system for controlling a plurality of elevator cars arranged for parallel operation for serving a plurality of service floor landings of a building, comprising hall call registering means disposed at the landing of each floor for originating hall calls, cage call registering means disposed in each said car for instructing target floors, waiting time display means disposed at the landing of each floor, means for selecting suitable ones of said cars for serving hall calls, means for allotting the hall calls to said selected cars, and means for forecasting the length of time required for each of said selected cars to arrive at the landing of each of the allotted hall call originating floors and displaying the forecast waiting time on each of said display means, said serving car selecting means comprising means for detecting for each said car the number of floors subject to change in forecast waiting time displayed at each of the already allotted floors when a new hall call is originated from one of the floors and one of the cars is selected to respond to the new hall call, and means for preferentically selecting the car detected to provide a smaller number of floors subject to change in displayed forecast waiting time than the others.

2. An elevator car group control system as claimed in claim 1, wherein, when two or more of said cars are detected to satisfy the condition that the number of floors subject to change in displayed forecast waiting time is less than or equal to a predetermined setting, the car is preferentially selected which provides a shorter forecast waiting time than the others.

3. An elevator car group control system as claimed in claim 1, wherein, when two or more of said cars are detected to satisfy the condition that the forecast waiting time is shorter than a predetermined setting, the car is preferentially selected which provides a smaller number of floors subject to change in displayed forecast waiting time than the others.

4. An elevator car group control system as claimed in claim 2, wherein said predetermined setting is increased when none of said cars are detected to satisfy the condition specified.

5. An elevator car group control system as claimed in claim 3, wherein said predetermined setting is increased when none of said cars are detected to satisfy the condition specified.

6. An elevator car group control system as claimed in claim 2, wherein said predetermined setting is increased when the shortest forecast waiting time amont those satisfying the condition specified exceeds said predetermined setting.

7. An elevator car group control system as claimed in claim 3, wherein said predetermined setting is increased when the minimum number of floors subject to change in displayed forecast waiting time among those satisfying the condition specified exceeds said predetermined setting.

* * * * *